United States Patent [19]

Kessler, Sr.

[11] 3,995,926

[45] Dec. 7, 1976

[54] FLAT-OPENING BOX

[76] Inventor: Clarence J. Kessler, Sr., Lexington Ave., Rte. 1, Box 162, Rincon, Ga. 31326

[22] Filed: Jan. 15, 1976

[21] Appl. No.: 649,495

[52] U.S. Cl. ..... 312/325; 312/202; 312/244; 312/269; 312/276

[51] Int. Cl.[2] ..... A47B 88/00; A47B 53/00; A47B 95/02; A47F 5/00

[58] Field of Search ..... 312/266, 269, 275, 276, 312/289, 201, 202, 244, 10, DIG. 32, DIG. 33, 117, 197

[56] References Cited

UNITED STATES PATENTS

| | | | |
|---|---|---|---|
| 159,501 | 2/1875 | Cogswell | 312/266 |
| 264,749 | 9/1882 | Potts | 312/197 |
| 814,572 | 3/1906 | Thilborger et al. | 312/266 |
| 1,059,781 | 4/1913 | Stephen | 312/202 |
| 2,044,661 | 6/1936 | Bentz | 312/244 |
| 2,081,856 | 5/1937 | Frick | 312/202 |
| 2,385,738 | 9/1945 | Stanton | 312/276 |
| 2,598,976 | 6/1952 | Cox | 312/266 |
| 2,880,918 | 4/1959 | Schweikhard | 312/269 |
| 3,485,543 | 12/1969 | Selden et al. | 312/202 |
| 3,758,977 | 9/1973 | Miller | 312/201 |

*Primary Examiner*—Paul R. Gilliam
*Assistant Examiner*—V. Sakran
*Attorney, Agent, or Firm*—Mason, Fenwick & Lawrence

[57] ABSTRACT

A flat opening box consisting of a central base tray to the sides of which cover shells are hingedly connected to open out onto a flat surface; pivot link members are connected to movable trays in the cover shells which are also hingedly connected to the cover shells so that the box can be opened to a fully flat condition to prevent tilting and spillage of its contents when open.

8 Claims, 12 Drawing Figures

74
70
72
54
74'
70
58
52
58'
56'
70'
44
48
12
64
66
70
82
80
108
86
110
84
101
46
104
50
58
100
52
60
108
100
56
104
12
48
44
22
16
28
24
80'
101'
84'
64'
82'
86'
66'
100'
56'
58'
54
74'
4
66
74
70
82
64
70
58
101
46
28
80
104
50
101'
16
104'
84'
64'
104
44
104'
86'
48
66'
100'
74'
58'
4

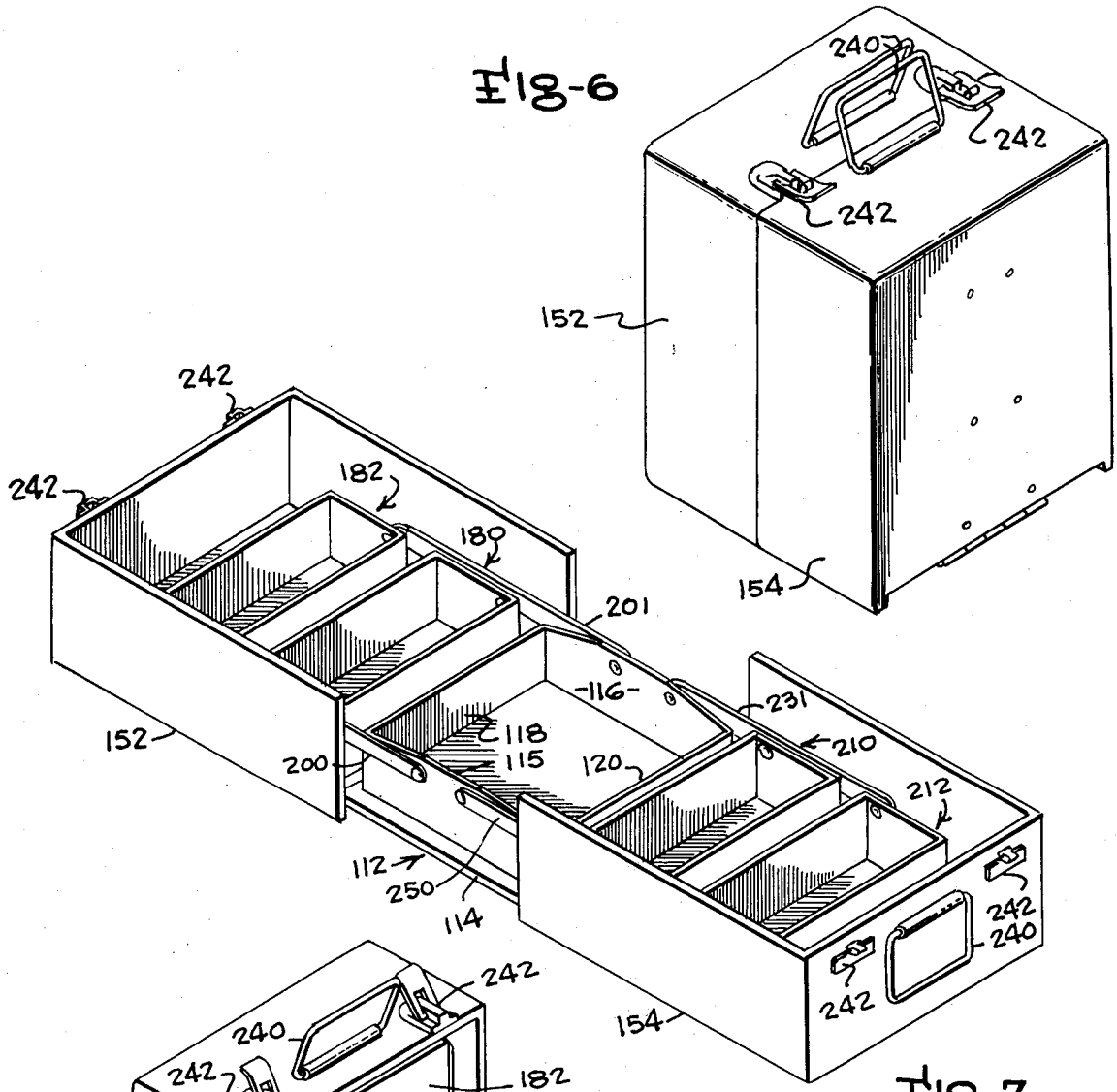
Fig-6
Fig-7
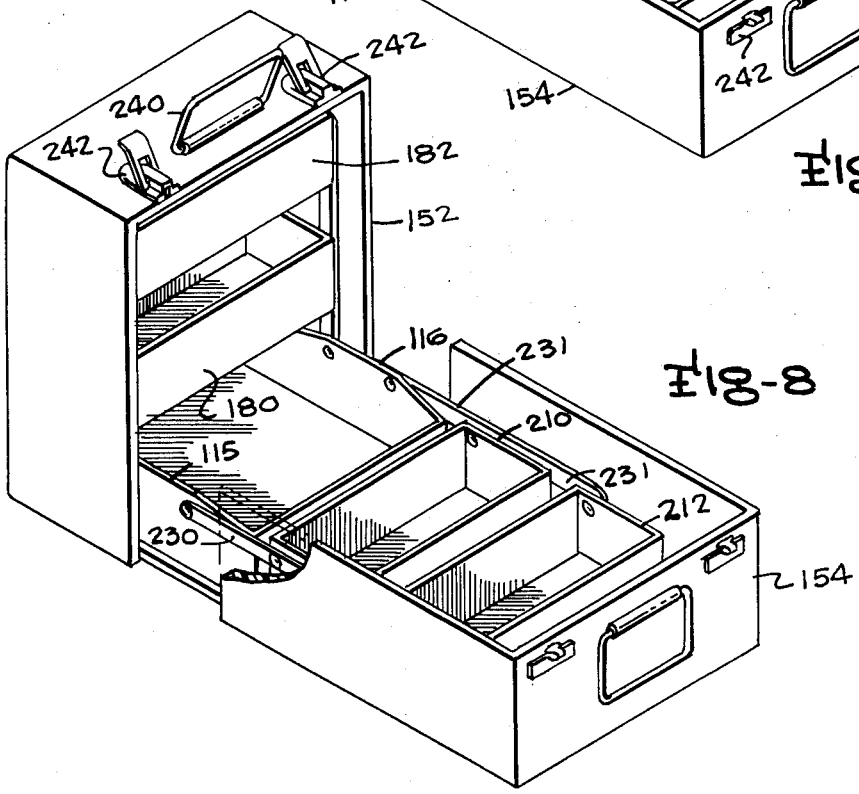
Fig-8

FLAT-OPENING BOX

This invention is in the field of containers and is more specifically directed to the field of portable containers such as tackle boxes, tool chests and the like in which movable tray members are provided within a metal, plastic or similar shell-type housing.

Previously known compartmented boxes such as tackle boxes have employed a housing having top portions hingedly mounted on a box portion which are movable to an open position to display the tray contents. However, opening of such previously known devices results in the cover and tray members extending outwardly in a cantilever manner from the box with the tray portions being supported solely by the lower box portion in a precarious manner. Consequently, such boxes are easily tipped over to result in a spillage of the contents of the box. Another difficulty with the prior known boxes of this same general type is that they frequently employ complicated linkage mechanisms for opening and closing the removable cover portions and their associated movable tray members.

Therefore, it is the primary object of this invention to provide a new and improved flat-opening box.

A still further object of the invention is the provision of a new and improved flat-opening box having internal movable trays which open outwardly to provide a large supporting surface resistant to overturning.

Yet another object of the invention is the provision of a new and improved flat-opening box having movable internal tray members supported by simplified linkage means for movement between and open and closed position of the box.

Achievement of the foregoing objects is enabled by the provision of a flat-opening box including a centrally positioned base tray having outwardly opening first and second cover shells hingedly connected at the bottom of opposite sides of the base tray so that the cover shells can be opened outwardly to extend along a supporting surface. A pair of movable rectangular tray members are pivotally mounted in each of the cover shells with each pair of tray members being connected at their front and rear ends by a front link and a rear link pivotally connected to the base tray and extending outwardly past the front and rear ends of the movable trays. The pivot links are pivotally connected to the movable trays at an upper corner of the trays which are pivotally connected at diametrically opposite corners by hinge means to the inner surface of the cover shell with which the trays are associated. Consequently, the link means, each tray and the associated cover shell comprise a parallel linkage which keeps the trays level for all cover positions between closed and fully open. When the box is fully opened, the cover shells rest flat on the supporting surface in horizontal alignment with the bottom portion of the base tray to provide a stable easily accessible box.

In another embodiment, the centrally positioned base tray is of regular hexagonal configuration with a cover shell and a pair of movable rectangular tray members being pivotally mounted adjacent each edge of the base tray. Each tray of the pair of tray members is connected at its front and rear end by a front link and a rear link pivotally connected to the base tray and extending outwardly past the front and rear ends of the movable trays. The base tray is mounted on a rotary pedestal type support for rotation about a vertical axis so that each bank of pivot trays is easily accessible by simply rotating same toward the user.

A better understanding of the manner in which the objects of the invention are achieved will be enabled when the following written description is considered in conjunction with the appended drawings in which:

FIG. 6 is a perspective view of a second embodiment of the invention in closed condition;

FIG. 7 is a perspective view of the embodiment of FIG. 6 in an open condition;

FIG. 8 is a perspective view of the embodiment of FIG. 6 with one side closed and one side open;

Figures 1, 2, 3:
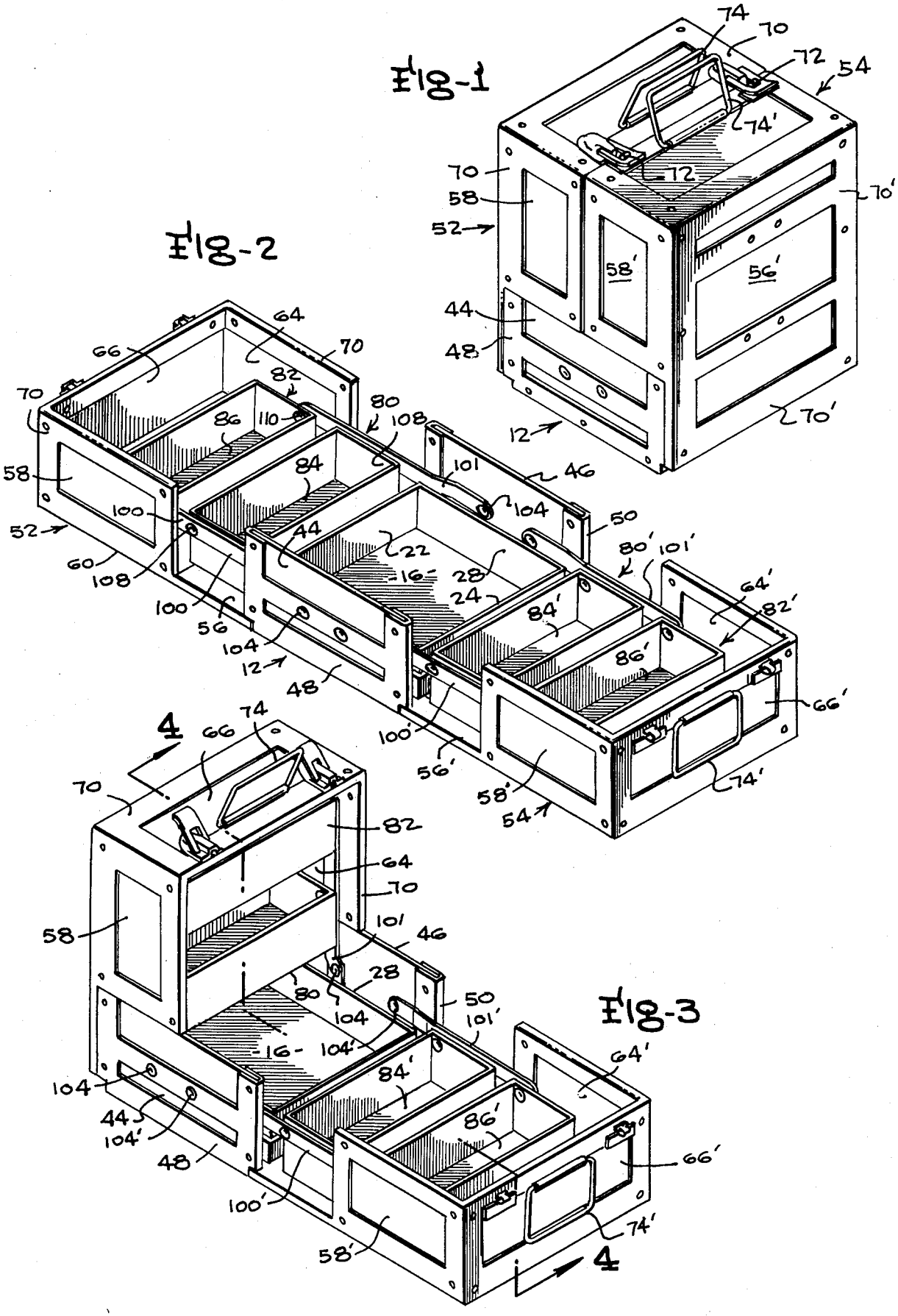
FIG. 1 is a perspective view of a first embodiment of the invention which is illustrated in closed condition.
FIG. 2 is a perspective view of the embodiment of FIG. 1 which is illustrated in an open condition.
FIG. 3 is a perspective view of the embodiment of FIG. 1 illustrated with one side open and one side closed.
Figure 5:
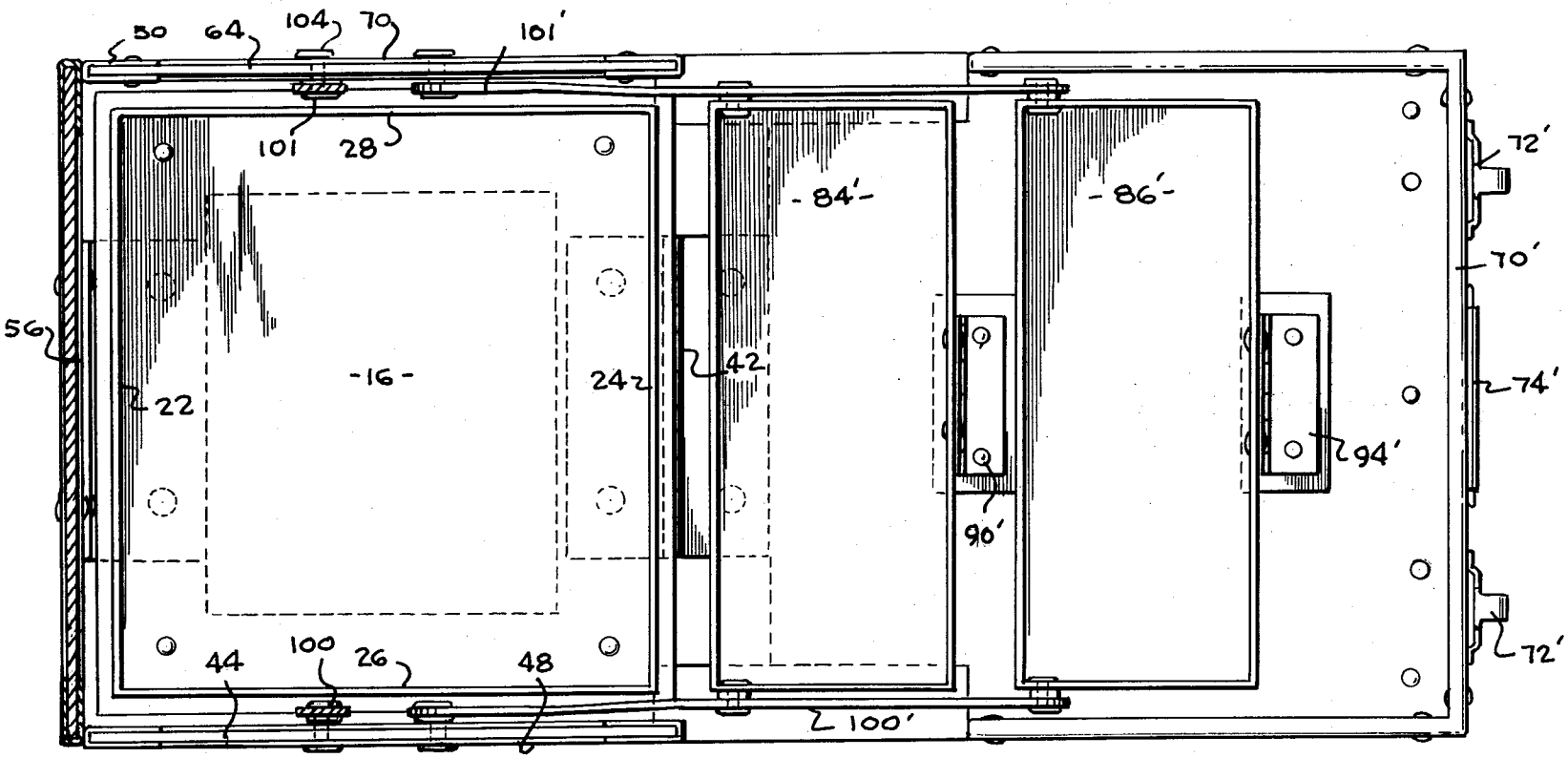
FIG. 5 is a sectional view taken along lines 5—5 of FIG. 4.

Turning first to FIGS. 1 and 2, the first embodiment, generally designated 10, comprises a flat-opening box construction in which the box can assume the closed position illustrated in FIG. 1 or can assume the flat open position illustrated in FIG. 2. Basic components of the first embodiment comprise a base tray 12 having a composite floor panel 14 consisting of an internal floor panel 16, an external floor panel 18 and a spacer panel 20 separating the panel components 16 and 18. Internal floor panel 16 is the bottom of an open-topped metal box having a first box side wall 22, a second box side wall 24, a box front wall 26 (FIG. 5) and a box rear wall 28. Protective metal strips 30 and 31 are provided along the side and front and rear edge surfaces of the external floor panel 18 on the bottom of panel 18. A reinforcing strip 32 is provided on the upper surface of the external floor panel 18 in hinge clearance slots between the external panel 18 and the internal box floor panel 16 along the two sides of the base tray which slots are provided by virtue of the fact that the spacer floor panel 20 is of less width than the width of the panels 16 and 18. The hinge clearance slots extend along the first and second sides of the base tray and provide a mounting space for a first cover hinge 40 and a second cover hinge 42. It should be understood that the metal box components 16 etc. and the floor panel components 18 and 20 (which can be formed of wood, metal or fiberboard) can be unitarily formed of plastic or the like if desired.

Base tray 12 additionally includes a fixed front cover panel wall 44 and a rear cover panel wall 46 formed of wood, fiberboard, plastic or the like, both of which are provided with protective and reinforcing sheet metal plates 48 and 50 respectively. The sheet metal places are bent around the side edges of the cover panel wall and the lower edges are bent downwardly under the front and rear portions of the external floor panel 18 to provide the front and rear protective strips 30 beneath the front and rear portions of panel 18.

Figure 4:
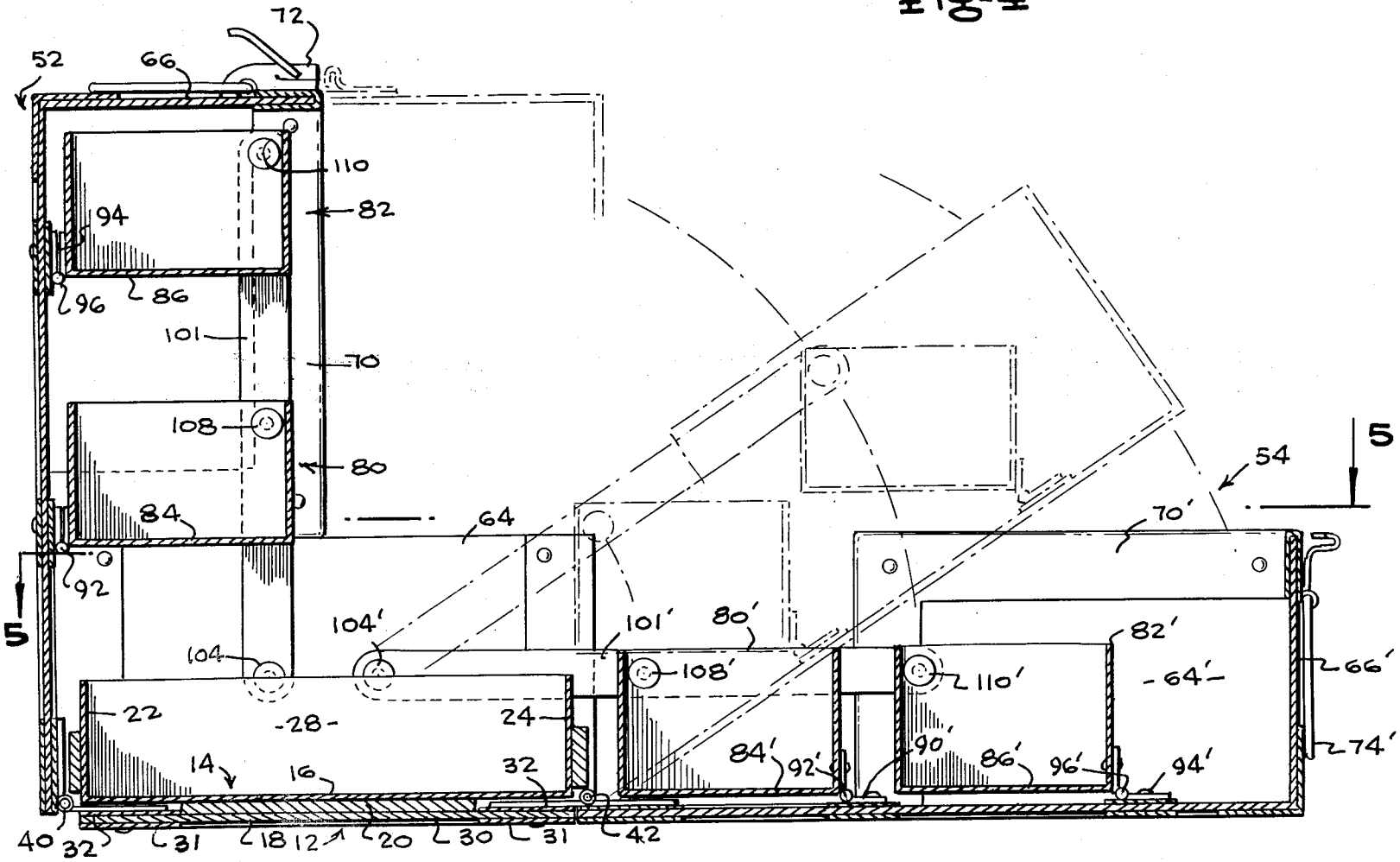
FIG. 4 is a sectional view taken along lines 4—4 of FIG. 3.

A first cover shell 52 is hingedly connected to the base tray 12 by first cover hinge 40 and a second cover shell 54 is hingedly connected to the second edge of the base tray 12 by the second cover hinge 42. The first cover shell 52 consists of a first side cover panel 56 which covers the entire side of the box when in the closed condition of FIG. 1 and as also illustrated in FIG. 4 and a front cover panel 58 co-planar with fixed front cover panel 44 joined at a front edge 60 to the front cover panel 56 and oriented perpendicularly with respect thereto. Additionally, a rear cover panel 64 is similarly connected to the side cover panel 56 with the first cover shell being completed by a top cover panel 66 that is perpendicular to the side cover panel 56 and the front and rear cover panels 58 and 64.

A sheet 70 of protective sheet metal is folded about and riveted to the first cover shell 52 for providing strength and protection for the cover shell as well as for ornamental appearance.

The second cover shell 54 is identical to the first cover shell and is in mirror relation thereto with the elements of the second cover shell having the same numerical designators as the corresponding elements of the first cover shell but with the designators of the second cover shell being primed. Consequently, the structural details of the second cover shell need not be discussed.

The cover shells 52 and 54 can be latched together in the closed position of FIG. 1 by means of latch members 72 and the closed box can be carried by handle members 74 and 74' in an obvious manner.

A first bank of movable side tray members consisting of an inner tray 80 and an outer tray 82 is mounted for opening and closing movement with the first cover shell 52 (the terms "inner" and "outer" being with respect to base tray 12 when in the positions of FIG. 2). Tray 80 includes a bottom panel 84 and tray 82 similarly includes a bottom panel 86 with both of the movable trays having side walls and front and rear walls oriented perpendicular to their bottom panels.

The inner tray 80 is connected by a tray hinge 90 to the first side cover panel 56 for pivotal movement about an axis 92 with respect to the panel 56 while the outer tray 82 is similarly connected by a tray hinge 94 for pivotal movement about a pivot axis 96. Front and rear swing links 100 and 101 are connected to the base tray 12 for pivotal movement about aligned pivots 104 in the front and rear walls 26 and 28 of tray 12. Similarly, the front and rear swing links 100 and 101 are pivotally connected to the front and rear walls of the inner tray 80 and outer tray 82 for pivotal movement about aligned axes 108 in the front and rear walls of tray 80 and aligned axes 110 in the front and rear walls of tray 82.

Similarly, the opposite side of base tray 12 is connected to a second bank of movable side tray members comprising tray members 80' and 82' identical to tray members 80 and 82. Tray members 80' and 82' are mounted in exactly the same manner as tray members 80 and 82 but which have been primed for clarity. Consequently, the respective parts of the trays 80' and 92' and the linkage means 100' and 101' etc, need not be discussed in detail.

In operation, the first and second cover shells 52 and 54 are movable between a first or open position as illustrated in FIG. 2 in which the components, 86, 84, 16, 84' and 86' are aligned in a horizontal plane with the side cover panels 56 and 56' resting on a supporting surface along with the bottom of the base tray 12. Consequently, a large supporting area is provided for the open tray and there is no danger of the tray tilting to spill its contents. The components can then be moved to the closed box position illustrated in FIG. 1 with the trays 80, 82 etc. remaining level during such movement as will be apparent from the dashed line intermediate position of FIG. 4.

When the box is in its closed condition illustrated in FIG. 1, the outer tray 82 is positioned in vertical alignment above inner tray 80 and the trays of the other bank of trays are similarly positioned. These results are achieved by virture of the fact that the link members 100 and 101 are connected to the movable trays and the cover shell in a parallelogram type linkage which maintains the horizontal orientation of the movable trays for all positions of movement.

The embodiment of FIGS. 6–8 is closely similar to the previously discussed embodiment of FIGS. 1–5 with the exception that the components such as the trays and the cover shells are formed of molded plastic or the like in a one-piece unitary construction. Additionally, the front cover panel wall 44 and the rear cover panel wall 46 are not part of the base tray, but are incorporated as a part of the movable cover shells.

More specifically, the embodiment of FIGS. 6–8 comprises a base tray 112 having a floor panel 114, a front wall 115, a rear wall 116, a first side wall 118 and a second side wall 120. Cover shells 152 and 154 are unitarily formed of plastic or the like and are hingedly connected to the side edges of the floor panel member 114 in the same manner that cover shells 52 and 54 are connected to tray 12. Movable trays 180 and 182 of a first bank of trays are respectively hingedly connected to the first cover shell 152 in the same manner that the trays 80 and 82 are connected to the cover shell 52. similarly, the movable trays 180 and 182 are also connected to swing link members 200 and 201 in the same manner that trays 80 and 82 are connected to the swing link members 100 and 101.

A second bank of movable trays comprising first and second movable trays 210 and 212 are hingedly connected to the second cover shell 154 and swing link members 230 and 231 in the same manner that the movable trays 180 and 182 are connected to corresponding members on the other side of the device. Handles 240 and latch means 242 serve the same purpose as the handles and latch members of the first embodiment.

Therefore, it will be seen that the embodiment of FIGS. 6–8 operates in the same manner as the first embodiment in that the movable trays remain oriented in the same manner as they move from the open position of FIG. 7 to the closed position of FIG. 6 with the box being openable to a full flat position illustrated in FIG. 7.

FIGS. 9–12 illustrate a third embodiment of the invention in which a base tray 199 having a composite floor panel formed of components 200 and 201 welded or otherwise bonded together to provide a uniform panel is supported for rotation about a vertical axis on the upper end of a pedestal type support 202.

A rotary bearing plate 204 is mounted on the upper end of support 202 and ball bearings 206 ride in a circular groove in the upper face of the bearing plate 204 and supportingly engage the downwardly facing surface of a similar circular groove in a bearing plate 208 welded to the lower side of the floor panel component 201.

A rigid spacer column 210 extends upwardly from the upper surface of the floor panel component 200 and supports a center latch plate 211 on its upper end. First and second rotary bearing plates 212 and 214 having interposed roller bearings in the same manner as bearing plates 204 and 208 are mounted between the upper surface of the latch plate 211 and a nut 215 on the upper end of an elongated retainer bolt 216. The head 218 of the retainer bolt engages the lower surface of bearing plate 204 and the remainder of the bolt passes through openings in the elements 204, 208, 210, 211, 214 and 212 with the bolt 215 holding the assembly in position so that the elements between the bearing plates 214 and 204 are free to rotate about the axis of the retainer bolt 216 in an obvious manner. The components mounted on the floor panel component 200 serve as a base tray in the manner of base tray 12 of the first embodiment and include six open-topped box or tray members generally designated 220 and each comprising a first or outer wall 222, two side walls 224, two converging walls 226 and an end wall 228 all of which extend upwardly from a tray floor 230 which is fixedly connected by adhesive, rivets or other conventional means to the upper floor panel component 200.

A side cover shell 232 is hingedly connected to each of the edge portions of the floor panel component 200 by means of hinge members 234. Each of the side cover shells includes a side cover panel 236, a top panel 238 and inwardly extendinf side tab walls 240 extending inwardly from the edges of the side cover panels 236 and the top panel 238. The inner edge 242 of the top panel is of arcuate configuration so as to be received within the peripheral circular slot of the center latch plate 211 as shown in FIG. 11. A pivot latch 244 is mounted on the upper surface of each of the top panels 238 for engagement with a latch lug 246 provided in the upper surface of the latch plate 211 as shown in FIG. 11 so as to permit latched positioning of the side cover shell in a closed condition as illustrated in FIG. 9 and by three of the cover shells of FIG. 10 and also similarly illustrated in FIG. 11.

A bank of movable side tray members is associated with each of the side cover shells and comprises an inner tray 24 connected by a tray hinge 250 for pivotal movement with respect to the side cover panel 236 and an outer tray 252 similarly pivotally connected to the side cover panel 236 by hinge means 254. Front and rear swing links 256 have their inner ends pivotally connected at 258 to the side walls 224 and are pivotally connected to the inner tray 248 and outer tray 252 at pivotal connections 262 and 264 respectively.

Figure 10:
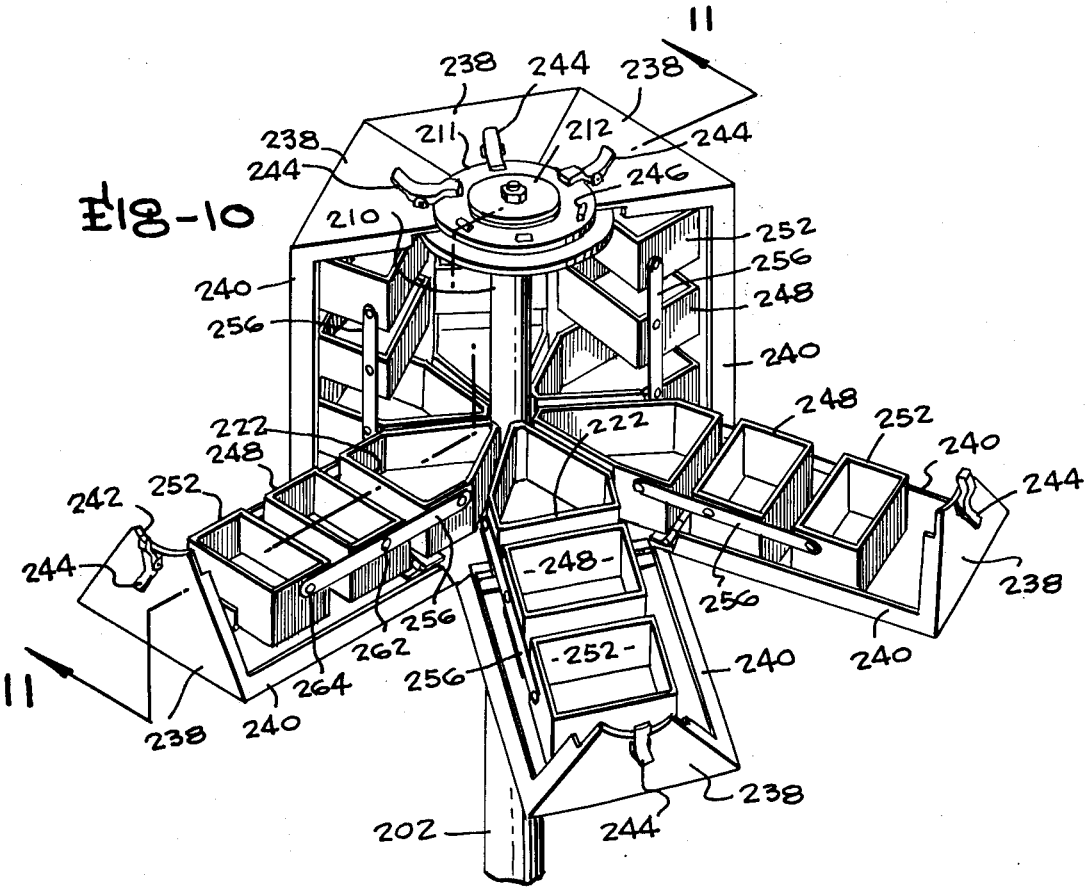
FIG. 10 is a perspective view similar to FIG. 9 but illustrating the third embodiment in a partially open condition.
Figure 11:
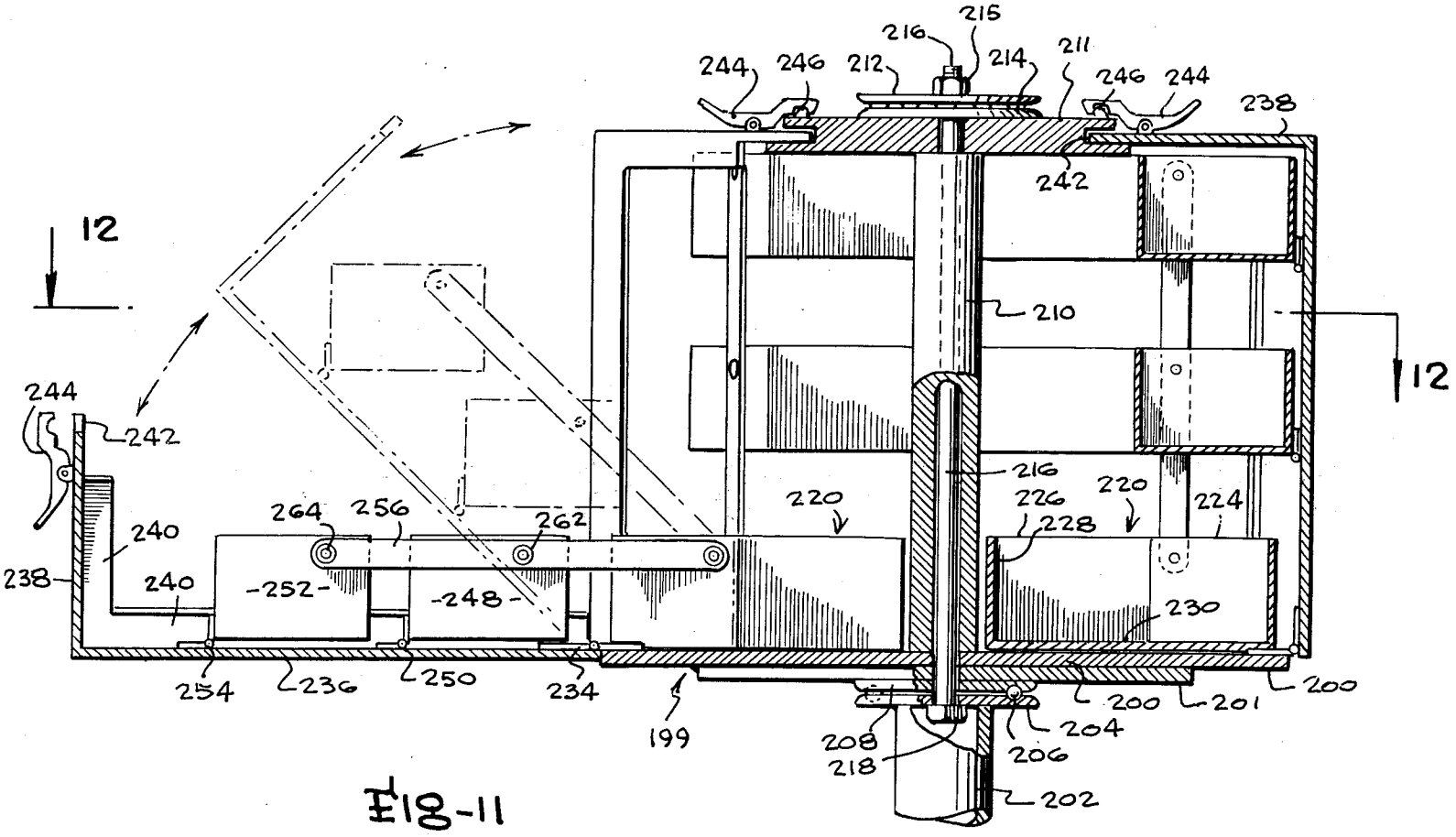
FIG. 11 is a sectional view taken along lines 11—11 of FIG. 10.
Figure 12:
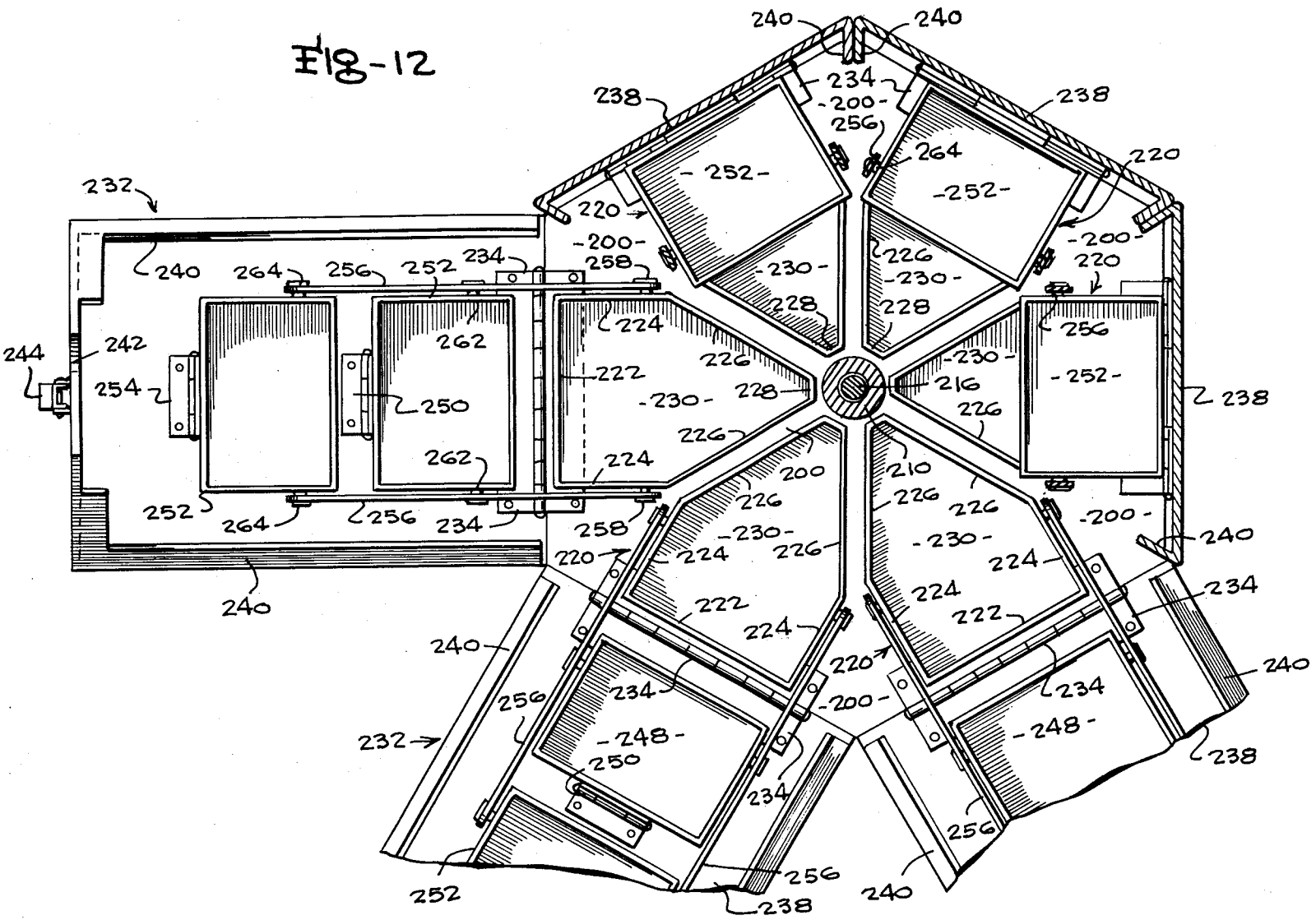
FIG. 12 is a sectional view taken along lines 12—12 of FIG. 11.

Pivotal movement of the side cover panels 236 to the outer or extended position illustrated by the leftmost tray of FIG. 11 and the three trays closest to the viewer in FIG. 10 serves to position the open-topped box members 220 and their associated tray members 248 and 252 in horizontal alignment as best illustrated in FIG. 11. It should be noted that the bottom panels of the tray members 248 and 252 remain parallel to the tray floor 230 of the box members 220 for all intermediate positions of the tray members as illustrated by the dotted line position of the components in FIG. 11.

Figure 9:
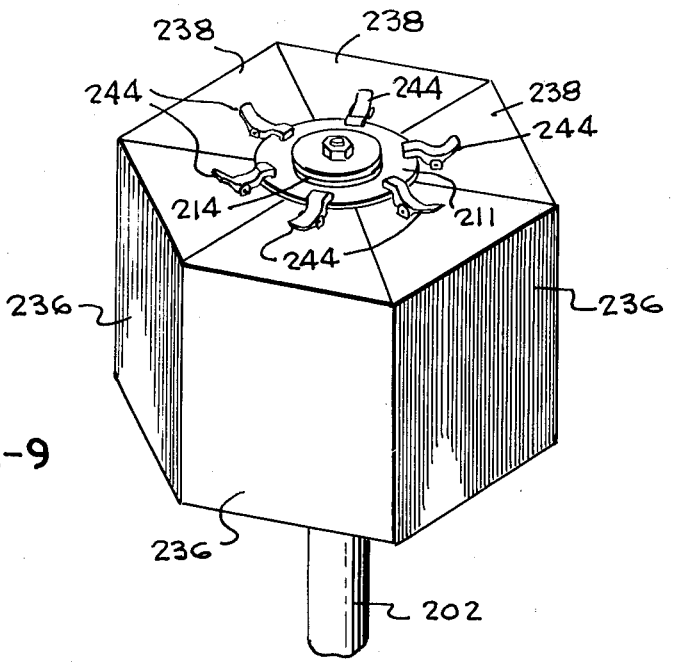
FIG. 9 is a perspective view of a third embodiment of the invention illustrated in a closed condition.

Moreover, the side cover panel 236 can be moved to the closed position illustrated by all of the cover panels in FIG. 9 and retained in this position by engagement of the latch members 244 with the latch lugs 246 in an obvious manner. The rotation of the entire assembly provided by the pivotal mounting on the pedestal 202 consequently provides an easily used and convenient means for storing small parts and the like. If the device is to be used as a tackle box, the lower end of the pedestal 202 could be provided with a mounting clamp or other suitable means for connection to a boat seat or the like. It should be understood that the trays can be formed of metal or plastic with the preferable construction being that of molded plastic in the manner of the embodiments of FIGS. 6–8. However, the trays and cover components can also be formed of individual rivet connected components in a manner similar to the embodiments of FIGS. 1–5.

Numerous modifications of the disclosed embodiments will undoubtedly occur to those of skill in the art. For example, the number of movable trays can be varied and the size of the trays need not be the same in the two banks of trays. Therefore, it should be understood that the spirit and scope of the invention is to be limited solely by the appended claims.

I claim:

1. A flat-opening box comprising a centrally positioned base tray having a first side wall, a second side wall, a rear wall, a front wall and a floor panel, a plurality of movable side tray members each having a bottom panel oriented parallel to said floor panel and linkage means connecting said base tray and said side tray members for movement of said side tray members along a path in which said bottom panels remain parallel to said floor panel between a first or open position in which said side trays are positioned in horizontal alignment with said base tray and a second position in which said movable side tray members are vertically aligned above said base tray, wherein said movable side tray members comprise a first bank of side tray members which when positioned in said first or open position are positioned outwardly of said first side wall of said base tray and a second bank of side tray members which when positioned in said first or open position are positioned outwardly of said second side wall of said base tray and said linkage means includes a first pair of elongated swing link members comprising a front link having one end pivotally mounted on said base tray adjacent said front wall and a rear link in front to rear alignment with said front link having one end pivotally mounted on said base tray adjacent said rear wall, pivot connection means pivotally connecting said front and rear swing links to each of said side tray members of said first bank of side tray members and a second pair of elongated swing link members comprising a second front link having one end pivotally mounted to said base tray adjacent said front wall and a second rear link in front to rear alignment with said second front link having one end pivotally mounted on said base tray adjacent said rear wall and pivot connection means piovtally connecting said second front and second rear swing links to each of said side tray members of said second bank of side tray members and a first cover shell pivotally connected to said base tray adjacent said first side wall, hinge means pivotally connecting each of said movable side tray members of said first bank of side tray members to said first cover shell, a second cover shell hingedly connected to said base tray adjacent said second side wall and hinge means connecting said movable side tray members of said second bank of side tray members to said second cover shell.

2. The invention of claim 1 wherein said base tray and said cover shells are unitarily formed of plastic.

3. The invention of claim 1 wherein said first cover shell comprises a first side cover panel which when said first bank of side trays are in their first position is oriented parallel to said floor panel in horizontal alignment therewith and which wheen said first bank of side trays is in its second position is oriented vertically and said second cover shell includes a second side cover panel pivotally connected to said base tray adjacent said second side wall which second side cover panel when said second bank of side tray members is in said first position is parallel to and aligned with said floor panel and which is oriented vertically when said second bank of side trays is in its second position.

4. The invention of claim 3 wherein said first cover shell additionally includes a top cover panel joined along one edge to and extending perpendicular from one edge of said first side cover panel, a front cover panel joined along a front edge of said first side cover panel and perpendicular to said first side cover panel and joined along an opposite edge and perpendicular to said top cover panel and a rear cover panel joined along and perpendicular to a rear edge of said first side cover panel and joined along another edge and perpendicular to a rear edge of said top cover panel, and wherein said second cover shell includes the same elements as the first cover shell associated in the same manner as the elements of the first cover shell.

5. The invention of claim 1 wherein said pivotal connections of said swing link members to said movable tray members are at a location diametrically spaced from the pivotal connections of said tray members to said cover shells.

6. The invention of claim 5 wherein said first and second cover shell members are hingedly connected to said base tray at a location adjacent the lowermost extent of said base tray.

7. A flat-opening box comprising a centrally positioned base tray having a floor panel of hexagonal configuration, a plurality of open-topped fixed tray members mounted on said floor panel, each of said fixed open-topped tray members being associated with a respective side edge of said floor panel and having a side wall contiguously adjacent said respective side edge of said floor panel, a bank of movable side tray members mounted adjacent to each respective edge of said floor panel, each bank of movable side tray members associated with each side edge of said floor panel comprising a plurality of movable side tray members each having front and rear end walls and a bottom panel, a front swing link and a rear swing link associated with each bank of movable side tray members, each of said swing links having an inner end pivotally connected to the base tray on said floor panel associated with the respective edge of said floor panel with which the particular bank of tray members is associated, pivot means connecting said front and rear swing links to upper portions of said front and rear end walls of each of said movable side tray members on a side of said end walls closest to the center of said floor panel, a cover panel associated with each bank of open-topped tray members pivotally connected to the respective edge of said floor panel with which its bank of movable side tray members is associated, hinge means connecting each cover panel to the tray members of the bank of tray members with which it is associated at a lower outer edge portion of said movable side tray members spaced farthest from the center of said floor panel, so that each bank of movable side tray members is capable of movement between a closed position in which the movable side tray members are stacked in vertical alignment above each other and above said base panel and an open position in which the movable side tray members extend outwardly in a general horizontal alignment with their bottom panel portion in approximate horizontal alignment with said floor panel.

8. A flat-opening box comprising a centrally positioned base tray having a first side wall, a second side wall, a rear wall, a floor panel, a bank of movable side tray members mounted for movement about said first side wall, each of said movable side tray members having a bottom panel oriented parallel to said floor panel, a front tray wall and a rear tray wall, an elongated front swing link member positioned adjacent said front tray walls of said movable side tray members, pivot means connecting one end of said front swing link member to said base tray at an elevated position adjacent said front wall of said base tray, a pivot connection provided in each of said front walls of said movable side tray members at an upper inner corner thereof, a cover member hingedly connected to said base tray adjacent the lower extent of said first side wall, a pivotal connection between each of said movable side tray members and said cover member at a location adjacent the bottom panel of each of said movable side tray members outwardly positioned with respect to said pivotal connection of said front swing link to said movable side tray members, an elongated rear swing link member positioned adjacent said rear tray walls of said movable side tray members, pivot means connecting one end of said rear swing link member to said base tray at an elevated position adjacent said rear wall of said base tray, a pivot connection provided in each of said rear walls of said movable side tray members at an upper inner corner thereof wherein said cover member is movable in a closed position in which said movable side tray members are stacked in aligned vertical array above said bottom panel and an open position in which said movable side tray members extend in horizontal alignment, said movable side tray members maintaining their bottom panels in a horizontal plane for all intermediate positions of movement.

* * * * *